US010801158B2

(12) United States Patent
Bang et al.

(10) Patent No.: US 10,801,158 B2
(45) Date of Patent: Oct. 13, 2020

(54) DRYER APPARATUS AND CONTROL METHOD THEREOF

(71) Applicant: SAMSUNG ELECTRONICS CO., LTD., Suwon-si, Gyeonggi-do (KR)

(72) Inventors: Eun-suk Bang, Hwaseong-si (KR); Hyung-woo Lee, Suwon-si (KR); Ji-hyun Woo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 218 days.

(21) Appl. No.: 15/840,657

(22) Filed: Dec. 13, 2017

(65) Prior Publication Data

US 2018/0179694 A1 Jun. 28, 2018

(30) Foreign Application Priority Data

Dec. 23, 2016 (KR) ..... 10-2016-0178442

(51) Int. Cl.

| | |
|---|---|
| ***D06F 58/30*** | (2020.01) |
| ***D06F 34/28*** | (2020.01) |
| ***D06F 58/38*** | (2020.01) |
| ***D06F 103/08*** | (2020.01) |
| ***D06F 103/38*** | (2020.01) |
| ***D06F 105/28*** | (2020.01) |

(52) U.S. Cl.
CPC ..... *D06F 58/30* (2020.02); *D06F 34/28* (2020.02); *D06F 58/38* (2020.02); *D06F 2103/08* (2020.02); *D06F 2103/38* (2020.02); *D06F 2105/28* (2020.02)

(58) Field of Classification Search
CPC ..... D06F 58/28; D06F 2058/2883; D06F 2058/2896; D06F 2058/2829; D06F 2058/289; D06F 58/30; D06F 34/28; D06F 58/38; D06F 2103/08; D06F 2103/38; D06F 2105/28; D06F 58/00; D06F 58/02; D06F 2103/36; D06F 2105/24
See application file for complete search history.

(56) References Cited

U.S. PATENT DOCUMENTS

2006/0242856 A1 11/2006 Kim et al.
2010/0138055 A1 6/2010 Jun et al.
(Continued)

FOREIGN PATENT DOCUMENTS

DE 10 2008 052 836 B4 2/2016
JP 9-290095 11/1997
(Continued)

OTHER PUBLICATIONS

Extended European Search Report dated Jun. 17, 2019 in European Patent Application No. 17882597.2.
(Continued)

*Primary Examiner* — Jessica Yuen
(74) *Attorney, Agent, or Firm* — Staas & Halsey LLP

(57) ABSTRACT

A drying apparatus is provided. The drying apparatus includes a first drying device including a drying basket and a first heater configured to provide hot air to the drying basket, a second drying device which is coupled with the first drying device and includes a drying drum and provides hot air to the drying drum, and a controller configured to, in response to the first drying device and the second drying device being simultaneously operated, reducing a heating performance of at least one of the first heater and the second heater.

18 Claims, 8 Drawing Sheets

(56) References Cited

U.S. PATENT DOCUMENTS

| | | | |
|---|---|---|---|
| 2011/0041258 | A1 | 2/2011 | Ko et al. |
| 2011/0062145 | A1 | 3/2011 | Yang et al. |
| 2013/0180121 | A1 | 7/2013 | Lee |

FOREIGN PATENT DOCUMENTS

| | | |
|---|---|---|
| JP | 2002-66197 | 3/2002 |
| KR | 10-0774206 | 11/2007 |
| KR | 10-1063652 | 9/2011 |
| KR | 10-1181770 | 9/2012 |
| KR | 10-2013-0083670 | 7/2013 |
| WO | 2016/137181 A2 | 9/2016 |

OTHER PUBLICATIONS

International Search Report dated Feb. 21, 2018, in corresponding International Patent Application No. PCT/KR2017/013035, 3 pgs.
Written Opinion of the International Searching Authority dated Feb. 21, 2018, in corresponding International Patent Application No. PCT/KR2017/013035, 8 pgs.
European Communication dated Jan. 24, 2020 in European Patent Application No. 17882597.2.

FIG. 3

| GAS MODEL | HEAT SOURCE | OUTPUT(W) | CURRENT(A) | ONLY UPPER PART USED | ONLY LOWER PART USED | OPERATE SIMULTANEOUSLY (IGNITION) | OPERATE SIMULTANEOUSLY (COMBUSTION) |
|---|---|---|---|---|---|---|---|
| UPPER PART | HEATER 1 | 270 | 2.5 | O | X | X | O |
| | HEATER 2 | 270 | 2.5 | O | X | X | O |
| LOWER PART | IGNITER | 600 | 5 | X | O | O | X |
| | HEATER | 400 | 3.5 | X | O | O | O |
| TOTAL CURRENT(A) | | | | 5 | 8.5 | 8.5 | 8.5 |

FIG. 4

| ELECTRIC MODEL | HEAT SOURCE | OUTPUT (W) | CURRENT (A) | ONLY UPPER PART USED | ONLY LOWER PART USED | OPERATE SIMULTANEOUSLY |
|---|---|---|---|---|---|---|
| UPPER PART | HEATER 1 | 270 | 2.5 | O | X | O |
| | HEATER 2 | 270 | 2.5 | O | X | O |
| LOWER PART | HEATER 3 | 3700 | 15.5 | X | O | O |
| | HEATER 4 | 1500 | 6.5 | X | O | X |
| TOTAL CURRENT(A) | | | | 5 | 22 | 20.5 |

FIG. 5

| CYCLE | TIME | HEATER | | HEATING_1 (HEATER ON) | | HEATING_2 (HEATER ON) | | COOLING (HEATER OFF) | |
|---|---|---|---|---|---|---|---|---|---|
| | | ON | OFF | MOTOR SPEED | TIME | MOTOR SPEED | TIME | MOTOR SPEED | TIME |
| SWEATER | 55 | 44 | 42 | HIGH | 49 | LOW | 5 | LOW | 1 |
| SHIRT/BLOUSE | 50 | 43 | 41 | MED. | 44 | LOW | 5 | LOW | 1 |
| UNDERGARMENT | 55 | 43 | 41 | MED. | 49 | LOW | 5 | LOW | 1 |
| ACCESSORY | 40 | 42 | 40 | LOW | 34 | LOW | 5 | LOW | 1 |

DRYER APPARATUS AND CONTROL METHOD THEREOF

CROSS-REFERENCE TO RELATED APPLICATION

This application is based on and claims priority from Korean Patent Application No. 10-2016-0178442, filed in the Korean Intellectual Property Office on Dec. 23, 2016, the disclosure of which is incorporated herein by reference in its entirety.

BACKGROUND

1. Field

Apparatuses and methods consistent with example embodiments relate to a drying apparatus and a control method thereof, and more particularly, to a drying apparatus including a plurality of drying devices, and a control method thereof.

2. Description of Related Art

A typical clothes dryer uses a method of putting clothes in a drying space (drum) and rotating them, and continuously drying the clothing by tumbling and exchanging heat with hot air. In addition, the clothes drying apparatus provided a rack to be fixed in the drum, thereby drying garments such as delicate clothes and wool nuts, which are vulnerable to heat or shrinkage.

That is, since the conventional drying apparatus performs a drying operation in one drying space, when clothes of different materials having different optimum drying temperatures are to be dried, they have to be separately sorted and dried sequentially. For example, conventional drying apparatuses have required high temperature drying of cotton clothes and low temperature drying of delicate garments upon completion of cotton clothes. Alternatively, cotton clothes and delicate clothes may be separately dried through two separate drying apparatuses, but when the drying apparatus having a large heater output is used, it may not be possible to use them simultaneously according to the power supply facility.

Further, since drying is progressed by the rotational tumbling, the delicate clothes may be damaged by friction.

Accordingly, there has been a demand for a drying apparatus capable of operating in a permissible current range while simultaneously allowing a plurality of drying apparatuses to be integrated into a high-temperature drying operation and a low-temperature drying operation. In addition, there has been a demand for a control method of a fan, a heater, and the like that can minimize damage depending on the type of clothes.

SUMMARY

One or more example embodiments provide a drying apparatus which controls a plurality of drying devices to be operated within an allowable current range, and a control method thereof.

According to an aspect of an example embodiment, there is provided a drying apparatus, comprising: a first drying device including a drying basket and a first heater configured to provide hot air to the drying basket; a second drying device which is coupled with the first drying device and includes a drying drum and a second heater configured to provide hot air to the drying drum; and a controller configured to reduce a heating performance of at least one of the first heater and the second heater.

The controller may reduce the heating performance of the at least one of the first heater and the second heater, in a state in which any one of the first drying device and the second drying device being operated and a turn-on command with respect to the other one from among the first drying device and the second drying device is input, or in a state in which the first drying device and the second drying device are requested to start operating simultaneously.

The second heater may have a power consumption higher than a power consumption of the first heater, and the controller may, in response to the first drying device and the second drying device being simultaneously operated, reduce a heating performance of the second heater.

The second heater may be a gas heater including an igniter and a valve configured to provide gas to the igniter, and the controller may reduce a heating performance of the second heater by blocking power supply applied to the igniter.

The second heater may be among a plurality of electric heaters, and the controller may reduce a heating performance of the second heater by blocking power supply applied to at least one of the plurality electric heaters which include the second heater.

The controller may in response to completion of a drying operation by the first drying device, restore the heating performance of the second heater.

The first heater may include an electric heater configured to heat air and a fan configured to generate air flow to allow air heated by the electric heater to enter the drying basket.

The first heater may provide hot air to the drying basket at a lower temperature than hot air provided to the drying drum by the second heater, and the controller may reduce a rotating speed of the fan after a predetermined threshold time.

The first drying device may further include a sensor configured to sense at least one from among humidity and temperature of the drying basket, and the controller may reduce a rotating speed of the fan based on the sensed at least one from among the humidity and temperature.

The controller may change a rotating speed of the fan based on at least one from among a type and weight of laundry input into the drying basket.

The first drying device may be coupled with an upper end of the second drying device and receive power supply from the second drying device.

According to an aspect of an example embodiment, there is provided a control method of a drying apparatus including a first drying device which includes a drying basket and a first heater configured to provide hot air to the drying basket and a second drying device which is coupled with the first drying device and includes a drying drum and a second heater configured to provide hot air to the drying drum, the method comprising operating one or more of the first drying device and the second drying device; and reducing a heating performance of one of the first heater and the second heater.

The reducing of the heating performance occurs, in a state in which any one of the first drying device and the second drying device being operated and a turn-on command with respect to the other one from among the first drying device and the second drying device is input, or in a state in which the first drying device and the second drying device are requested to start operating simultaneously, reducing a heating performance of one of the first heater and the second heater.

The second heater may have a power consumption higher than a power consumption of the first heater, and the reducing the heating performance may include, in response to the first drying device and the second drying device being simultaneously operated, reducing a heating performance of the second heater.

The second heater may be a gas heater including an igniter and a valve configured to provide gas to the igniter, and the reducing the heating performance may include reducing a heating performance of the second heater by blocking power supply applied to the igniter.

The second heater may be among a plurality of electric heaters, and the reducing the heating performance may include reducing a heating performance of the second heater by blocking power supply applied to at least one of the plurality of electric heaters which include the second heater.

The method may further include in response to completion of a drying operation by the first drying device, recovering a heating performance of the second heater.

The method may further include, in response to the first drying device being operated, heating air by the electric heater included in the first heater, and generating air flow by the fan included in the first heater to allow air heated by the electric heater to enter the drying basket.

The hot air provided to the drying basket may further lower in temperature than hot air provided to the drying drum, and the method may further include reducing a rotating speed of the fan after a predetermined threshold time.

The method may further include sensing at least one from among humidity and temperature of the drying basket, and reducing a rotating speed of the fan based on the sensed at least one from among the humidity and temperature.

According to the above-described various example embodiments, a drying apparatus may, when a plurality of drying devices are simultaneously operated, reduce a performance of one of the plurality of drying devices and simultaneously operate the plurality of drying device within an allowable current range.

BRIEF DESCRIPTION OF THE DRAWINGS

The above and/or other aspects will become more apparent by reference to example embodiments which are illustrated in the appended drawings. Understanding that these drawings depict only example embodiments and are not therefore to be considered to be limiting of the scope of the disclosure, the principles herein are described and explained with additional specificity and detail via the use of the accompanying drawings, in which:

FIG. 3 is a diagram illustrating an operation of a controller of a drying apparatus including a gas model, according to an example embodiment;

FIG. 4 is a diagram illustrating an operation of a controller of a drying apparatus including an electric model, according to an example embodiment;

FIG. 5 is a diagram illustrating an operation of a first drying apparatus, according to an example embodiment;

DETAILED DESCRIPTION

Figure 1:
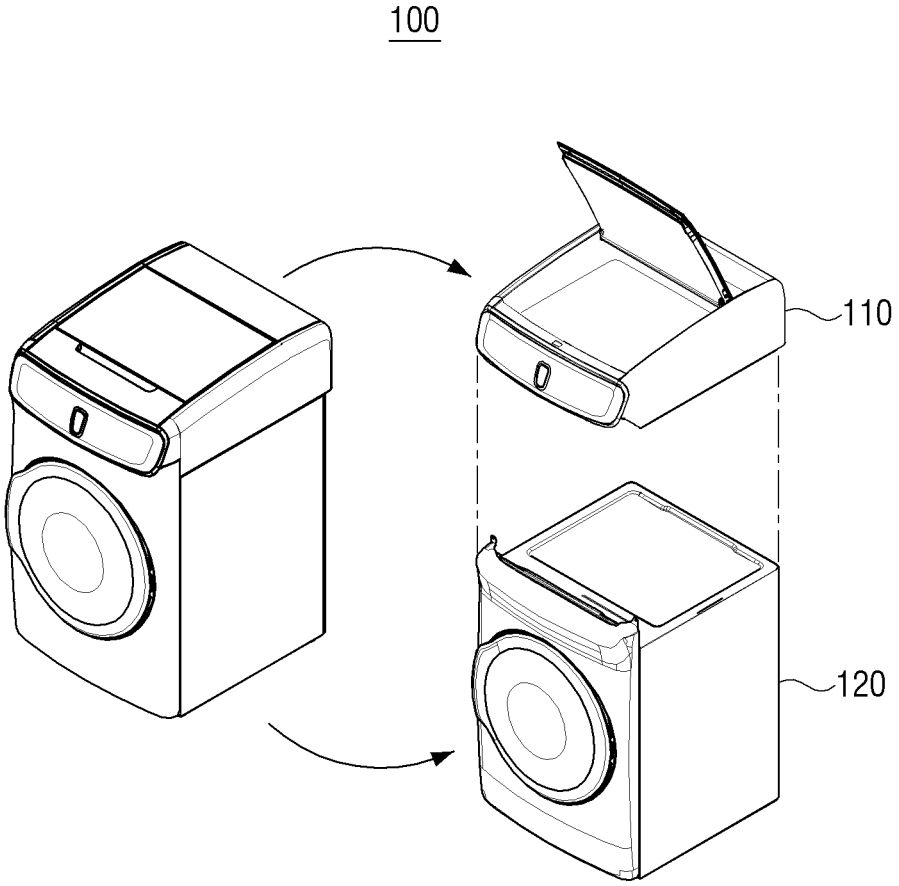
FIG. 1 is a diagram illustrating a structure of a drying apparatus, according to an example embodiment.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail since they would obscure the disclosure with unnecessary detail.

Hereinafter, various embodiments of the present disclosure will be described in detail with reference to the accompanying drawings.

FIG. 1 is a diagram illustrating a structure of a drying apparatus 100, according to an example embodiment.

The drying apparatus 100 may be an apparatus which removes moisture. For example, the drying apparatus 100 may be a drying apparatus for household use which dries laundry such as clothes, bedding, etc. that are cleaned.

The drying apparatus 100 may make moisture evaporate by using heat and hot air. For example, the drying apparatus 100 may generate heat or hot air by gas or electricity and make moisture evaporate. In this case, the drying apparatus 100 may include a fan, and make moisture evaporate by generating hot air by the fan.

Alternatively, the drying apparatus 100 may separate moisture mechanically. For example, the drying apparatus 100 may remove moisture by a centrifugal force generated by a high-speed rotation. Alternatively, the drying apparatus 100 may be implemented to complexly use the method described above.

The drying apparatus 100 may include a first drying device 110 and a second drying device 120. In this case, the first drying device 110 and the second drying device 120 may be used for different purposes. For example, the first drying device 110 may be a drying device for drying a small amount of laundry, and the second drying device 120 may be a drying device for drying a large amount of laundry.

Alternatively, the first drying device 110 may be a drying device for drying delicate clothes, and the second drying device 120 may be a drying device for drying laundry other than the delicate clothes. Alternatively, the first drying device 110 may be a drying device for low-temperature dry, and the second drying device 120 may be a drying device for a high-temperature dry.

The first drying device 110 may be a non-rotating rack type drying device, and the second drying device 120 may be a rotating drum type drying device. However, the example is not limited thereto, and the first drying device 110 and the second drying device 120 may be of the same type.

As illustrated in FIG. 1, the first drying device 110 may be coupled with an upper end of the second drying device 120. In addition, the first drying device 110 may be separated from the second drying device 120. However, the example is not limited thereto, and the first drying device 110 and the second drying device 120 may be coupled with each other using different methods as well. For example, a lateral side of the first drying device 110 may be coupled with a lateral side of the second drying device 120.

A guide may be formed on a connection surface in which the first drying device 110 and the second drying device 120 are coupled with each other. For example, a guide having a projected shape may be formed in a connection surface of the first drying device 110, and a guide having a depressed shape may be formed in a connection surface of the second drying device 120.

When the first drying device 110 and the second drying device 120 are coupled with each other through a guide, the first drying device 110 and the second drying device 120 may be coupled with each other by using a screw. Accordingly, the first drying device 110 and the second drying device 120 may be fixed as being coupled with each other.

However, the example is not limited thereto, and any method can be used as long as the first drying device 110 and the second drying device 120 are coupled with each other and fixed. For example, an edge of a connection surface of the first drying device 110 may be connected to an edge of a connection surface of the second drying device by using a hinge.

Meanwhile, the second drying device 120 may not be operated while the first drying device 110 is operated. On the other hand, the second drying device 120 may be operated while the first drying device 110 is not operated.

However, in a case in which the first drying device 110 and the second drying device 120 are simultaneously operated, a current that exceeds an allowable current range may be needed. Alternatively, in a state that one of the first drying device 110 and the second drying device 120 is operated, when the other one is turned on, a current that exceeds an allowable current range may be needed as well. In this case, an additional control method is required for the safe use.

A method for operating the first drying device 110 and the second drying device 120 will be described in greater detail below.

Figure 2:
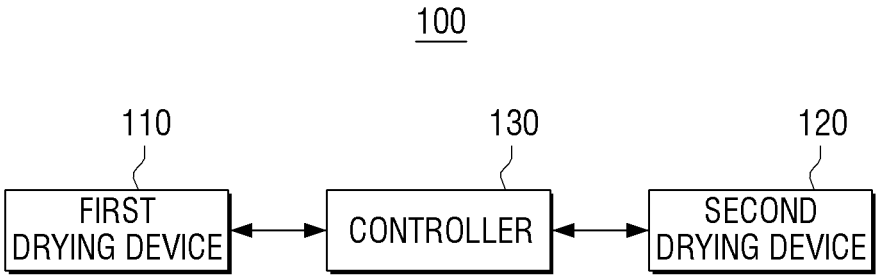
FIG. 2 is a block diagram illustrating a drying apparatus, according to an example embodiment.

FIG. 2 is a block diagram illustrating a drying apparatus 100, according to an example embodiment. Referring to FIG. 2, the drying apparatus 100 includes a first drying device 110, a second drying device 120, and a controller 130.

The first drying device 110 may include a drying basket and a first heater. In this case, the drying basket may be a configuration for containing laundry. In addition, the drying basket may include a plurality of holes to allow hot air to pass through.

The first heating unit may provide hot air to the drying basket. The first heating unit may include a heater for heating air and a fan for circulating heated air.

The second drying device 120 may be coupled with the first drying device 110, and may include a drying drum and a second heating unit. Here, the drying drum may be a configuration for containing laundry. In addition, a drying drum may be rotated during a drying operation.

The second heating unit may provide hot air to a drying drum. The second heating unit may include a heater for heating air and a fan for circulating heated air.

When the first drying device 110 and the second drying device 120 are simultaneously operated, the controller 130 may reduce a heating performance of one of the first heating unit and the second heating unit. For example, when the first drying device 110 and the second drying device 120 are simultaneously operated, the controller 130 may lower a temperature of hot air generated from the first heating unit.

In a state in which any one of the first drying device 110 and the second drying device 120 is operated, when a turn on command is input to the other one of the first drying device 110 and the second drying device 120, the controller 130 may reduce a heating performance of one of the first heating unit and the second heating unit.

For example, not only in a case in which a user turns on the first drying device 110 and the second drying device 120 at the same time, but also in a case in which any one of the first drying device 110 and the second drying device 120 is operated, when the other one of the first drying device 110 and the second drying device 120 is turned on, the controller 130 may reduce a heating performance of one of the first heating unit and the second heating unit.

In a case in which a power consumption of the second heating unit is greater than that of the first heating unit, when the first heating device 110 and the second heating device 120 are simultaneously operated, the controller 130 may reduce a heating performance of the second heating unit. That is, when the first drying device 110 and the second drying device 120 are simultaneously operated, the controller 130 may determine a drying device to reduce a heating performance based on power consumption.

However, the above-described example embodiment is merely exemplary, and the example is not limited thereto. For example, if the first drying device 110 and the second drying device 120 may be simultaneously operated by reducing a heating performance of the first drying device 110 in the above-described example embodiment, the controller 130 may reduce a heating performance of the first drying device 110.

For convenience of explanation, it will be described below, an example in which a power consumption of the second heating unit is greater than that of the first heating unit and in which when the first drying device 110 and the second drying device 120 are simultaneously operated, the controller 130 reduces a heating performance of the second heating unit.

The second heating unit may be a gas heater including igniter and a valve for providing gas to the igniter. The igniter may be heated when connected to power supply, and when a temperature of the igniter reaches a predetermined first temperature, a valve may be opened and gas may be provided to the igniter. When an igniter of a predetermined first temperature comes in contact with gas, the igniter is ignited and thus, surrounding air may be heated.

When the first drying device 110 and the second drying device 120 are simultaneously operated, the controller 130 may reduce a heating performance of the second heating unit by blocking power supplied to the igniter. When power supply is blocked, a temperature of the igniter may be gradually lowered or may remain ignited due to an opened valve. However, as the temperature of the igniter is lowered, the surrounding air is circulated with less heat, so that the heating performance can be reduced.

Meanwhile, the second heating unit may include a plurality of electric heaters. When the first drying device 110 and the second drying device 120 are simultaneously operated, the controller 130 may reduce a heating performance of the second heating unit by blocking power supplied to at least one from among the plurality of electric heaters. Due to the above-described operation, the first drying device 110 and the second drying device 120 may be simultaneously operated within an allowable current range.

In a case in which a heating performance of the second heating unit is decreased, when a drying operation by the first drying device is ended, the controller 130 may restore the heating performance of the second heating unit. That is, when the first drying device 110 is not operated, the controller 130 may restore a heating performance of the second heating unit.

Meanwhile, the first heating unit may include an electric heater which heats air and a fan which generates air flow to allow the air heated by the electric heater to flow into a drying basket.

The first heating unit may provide hot air of which the temperature is lower than that of hot air provided to the drying drum to the drying basket, and the controller 130 may decrease a rotation speed of the fan after a predetermined threshold time. When a rotation speed of the fan is decreased, a temperature of hot air may be improved.

Alternatively, the first drying device 110 may further include a sensor which senses at least one of humidity and temperature of the drying basket, and the controller 130 may reduce a rotation speed of the fan based on the sensed at least one of humidity and temperature.

Meanwhile, the controller 130 may change a rotation speed of the fan based on at least one of a type and weight of laundry input to a drying basket. For example, when the laundry is underwear, the controller 130 may relatively reduce a speed of the fan to provide a warm feeling to a user.

The first drying device 110 may be coupled with an upper end of the second drying device 120, and may be provided with a power supply from the second drying device 120. However, the example is not limited thereto, and various methods may be used to couple the first drying device 110 and the second drying device 120. In addition, the first drying device 110 and the second drying device 120 may respectively receive a power supply from an additional power supply apparatus.

An operation of the drying apparatus 100 will be described in greater detail below, with reference to the accompanying drawings.

FIG. 3 is a diagram illustrating an operation of a controller 130 of a drying device including a gas model, according to an example embodiment. In FIG. 3, it will be assumed that the first drying device 110 is positioned in an upper portion, that the second drying device 120 is positioned in a lower portion, that the first heating unit is an electric model, and that the second heating unit is a gas model.

As an output of a heater and fan of the drying apparatus 100 is increased, a drying time may be shortened. However, in order to output a maximum performance, it is necessary to increase an output of a heater and a fan within a maximum allowable current range that can be used in a general household. Hereinafter, it will be assumed that a magnitude of a maximum allowable current applied to the drying apparatus 100 is 12 A.

The first heating unit includes two electric heaters, and a current of 2.5 A flows through each of the two electric heaters. The second heating unit includes one gas heater, and the gas heater includes an igniter and a valve. During operation, a current of 5 A flows through the igniter, and a current of 3.5 A flows through the valve.

When only the first drying device 110 is operated, a current of 5 A flows through the first drying device, and when only the second drying device 120 is operated, a current of 8.5 A flows through the second drying device. When only one drying device is operated, a current is within a maximum allowable current of 12 A, so no problem occurs.

When the first drying device 110 and the second drying device 120 are simultaneously operated, a current of 13.5 A is needed and thus, a problem may occur. In this case, the controller 130 may temporarily cease operation of the first drying device 110 and operate the second drying device 120.

The controller 130 may supply power to the igniter and the valve for ignition. When the igniter reaches a predetermined first temperature, the controller 130 may block power supply applied to the igniter and operate the first drying device 110. In this case, the controller 130 may maintain a voltage applied to the valve. In this case, a current that flows through the drying apparatus 100 is 8.5 A, which is within the maximum allowable current range.

When the igniter cools down to a predetermined second temperature, the controller 130 may cease an operation of the first drying device 110 and supply power to the igniter as well. In this case, the predetermined second temperature may be lower than the predetermined first temperature. When the igniter reaches the predetermined first temperature again, the controller 130 may block power supply applied to the igniter and operate the first drying device 110.

Although it is described in FIG. 3 that a power supply applied to the igniter is blocked, but the example is not limited thereto. For example, the controller 130 may block power supply applied to a heater 1 of the first drying device 110. In this case, a current that flows through the drying apparatus is 11 A, which is within the maximum allowable current range.

That is, the controller 130 may reduce a heating performance of one of the first drying device 110 and the second drying device 120. That is, the controller 130 may determine a drying device of which the heating performance is to be reduced based on at least one of an amount and type of laundry input to the first drying device 110 and the second drying device 120.

According to circumstances, the controller 130 may reduce a heating performance of both the first drying device 110 and the second drying device 120. That is, the controller 130 may, after heating the igniter to a predetermined first temperature, block power supply applied to the heater 1 and the igniter. While the igniter is heated to the predetermined first temperature, the controller 130 may block power supply applied to the heater 2.

FIG. 4 is a diagram illustrating an operation of a controller of a drying apparatus 100 that includes an electric model, according to an example embodiment. In FIG. 4, it will be assumed that the first drying device 110 is positioned in an upper portion, that the second drying device 120 is positioned in a lower portion, and that the first heating unit and the second heating unit are electric models. In addition, it will be assumed that a magnitude of a maximum allowable current applied to the drying apparatus 100 is 25 A.

The first heating unit includes two electric heaters, and a current of 2.5 A flows through each of the two electric heaters. The second heating unit includes two electric heaters, and a current of 15.5 A and a current of 6.5 A flow through the two electric heaters, respectively.

When only the first drying device 110 is operated, a current of 5 A flows through the first drying device, and when only the second drying device 120 is operated, a current of 22 A flows through the second drying device. When only one drying device is operated, a current is within a maximum allowable current of 25 A, so no problem occurs.

When the first drying device 110 and the second drying device 120 are simultaneously operated, a current of 27 A is needed and thus, a problem may occur. In this case, the controller 130 may block power supply applied to one of the two electric heaters included in the second heating unit. For example, the controller 130 may block power supply applied to a heater 4 that requires a current of 6.5 A.

Alternatively, the controller 130 may block power supply applied to the heater 1 of the first drying device 110. In this case, a current that flows through the drying apparatus 100 is 24.5 A, which is within the maximum allowable current range.

That is, the controller 130 may reduce a heating performance of one of the first drying device 110 and the second drying device 120. That is, the controller 130 may determine a drying device of which the heating performance is to be reduced based on at least one of an amount and type of laundry input to the first drying device 110 and the second drying device 120.

For example, in a case in which a laundry of 10% of the total input capacity is input to the first drying device 110 and a laundry of 90% of the total input capacity is input to the second drying device 110, the controller 130 may reduce a heating performance of the first drying device 110.

According to circumstances, the controller 130 may reduce a heating performance of both the first drying device 110 and the second drying device 120. For example, the controller 130 may block power supply applied to the heater 1 and the heater 3.

Although FIGS. 3 and 4 illustrate that the first drying device 110 includes an electric heater, the example is not limited thereto. For example, both the first drying device 110 and the second drying device 120 may include a gas heater, and in this case, the controller 130 may be operated the same as well.

In addition, even if coupling methods of the first drying device 110 and the second drying device 120 are different from each other, the controller 130 may be operated the same. For example, the second drying device 120 may be coupled with an upper end of the first drying device 110, and in this case, the controller 130 may be operated the same way.

FIG. 5 is a diagram illustrating an operation of a first drying apparatus 110, according to an example embodiment. In FIG. 5, it will be assumed that the first drying device 110 includes an electric heater.

The first heating unit may include an electric heater which heats air and a fan which generates air flow to allow the air heated by the electric heater to flow into a drying basket. In this case, the fan may be operated by a motor having a variable RPM. FIG. 5 illustrates that a rotation speed of the motor is adjustable in three steps: low, medium and high. However, this is only an example, and a rotation speed may be adjusted in various manners.

The controller 130 may control the first drying device 110 based on a plurality of modes. The drying apparatus 100 may store information that relates to the plurality of modes. The controller 130 may control the first drying device 110 based on a mode that is set. For example, the drying apparatus 100 may store information that relates to a delicate mode, a normal mode, a high-speed mode, and the like. The controller 130 may control at least one from among an operation temperature of the heater, a rotation speed of the fan and a drying time according to the set mode.

First, the controller 130 may determine one of the plurality of modes based on at least one of a texture, thickness and type of the laundry. For example, when the laundry is a sweater, the controller 130 may determine a mode that corresponds to the sweater based on the plurality of modes.

According to the example illustrated in FIG. 5, a mode corresponding to the sweater may be a mode that sequentially proceeds in the order of a first heating step or operation, a second heating step or operation and a cooling step or operation. The first heating step may be 49 minutes in which a rotational speed of the fan may be high. The second heating step may be 5 minutes in which a rotational speed of the fan may be low. The temperature of the inside of the first drying device 110 can be increased by increasing the air staying time by keeping the rotational speed of the fan low during the second heating step.

The cooling step may be 1 minute in which a rotational speed of the fan may be low. In this case, the heater may be operated during the first heating step and the second heating step, and the heater may not be operated during the cooling step.

The heater is maintained in a state of being turned on by 44 degrees, and is turned off at 44 degrees so that a temperature is gradually decreased. When a temperature of the heater is lowered to 42 degrees, the heater may be turned on until it reaches 44 degrees again. The heater may repeat such operation during the first heating step and the second heating step.

In FIG. 5, it is assumed that the controller 130 determines one of a plurality of modes based on at least one from among a texture, thickness and type of the laundry, but the example is not limited thereto. For example, a mode may be determined according to a user command to select one of a plurality of modes.

In addition, the controller 130 may sense the laundry in real time separately from the mode, and may control the first drying device 110. First, the controller 130 may sense the laundry to determine a method of drying operation.

For example, a laundry such as a wool (sweater) contains relatively high water content, and the controller 130 may increase a rotating speed of the fan to quickly discharge moisture generated by the laundry. Alternatively, a temperature and an air volume are important for a laundry having an inner sponge such as an underwear, a ladies' top, and the like, and the controller 130 may reflect the above and maintain the rotating speed of the fan medium or high. Alternatively, a temperature and an air volume are important for a laundry having a partially thick part such as a collar and a sleeve, such as a shirt or the like, and the controller 130 may reflect the above and maintain the rotating speed of the fan medium or high. Alternatively, the thin and light type laundry such as a scarf, a pantyhose, and the like. has a small moisture content and is light in weight. The controller 130 reflects the low moisture content, maintains the rotating speed of the fan at a low level to raise the drying efficiency and keeps flap minimum.

First, the controller 130 may determine a processing method of a drying operation based on at least one from among a temperature and humidity sensed in real time. In this case, the first drying device 110 may include a sensor which senses at least one of a temperature and humidity in real time.

For example, if a drying operation is performed during a predetermined drying time but humidity is high due to a large amount of laundry, the controller 130 may perform an additional drying operation.

Figure 6:
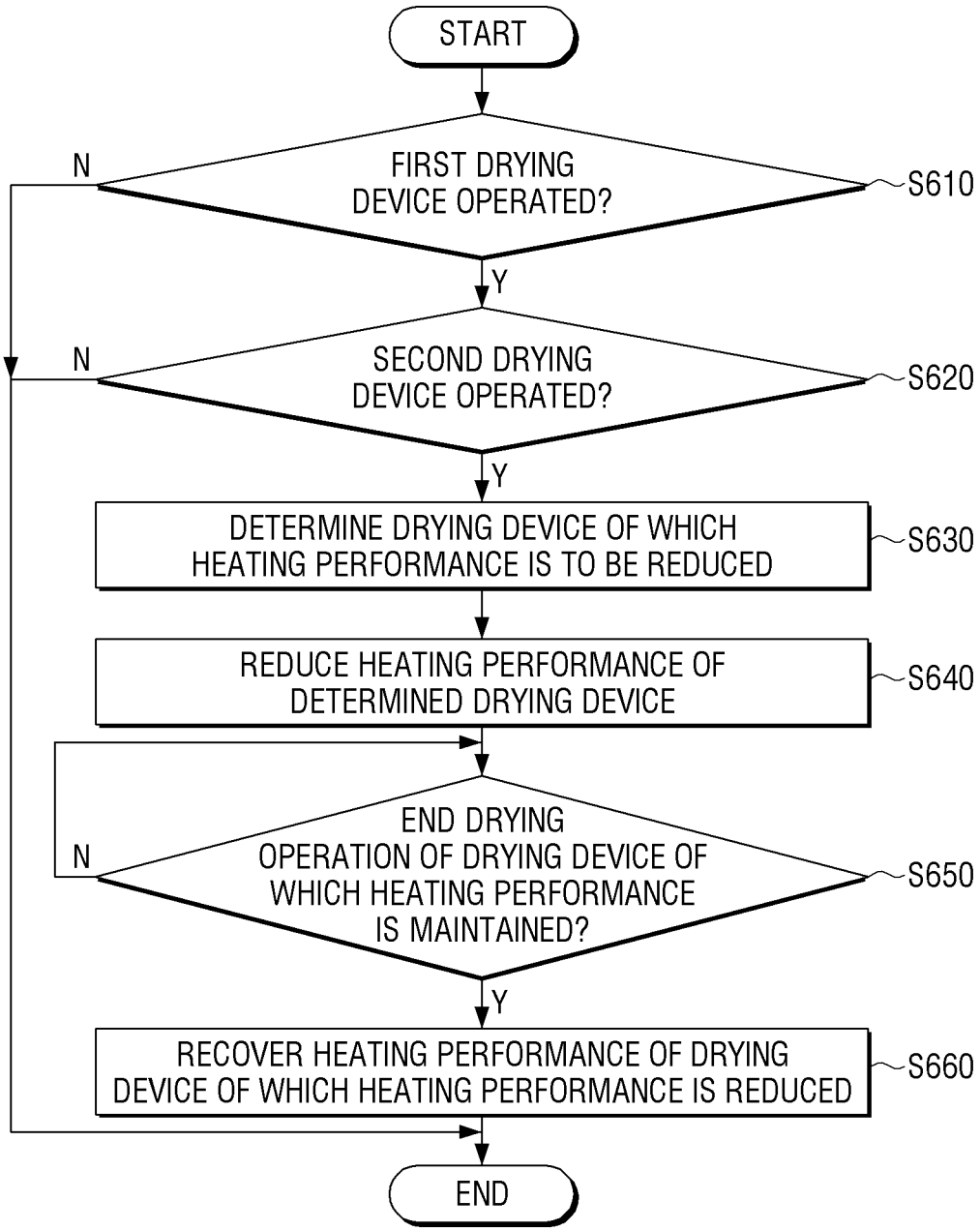
FIG. 6 is a flowchart illustrating an operation of a controller, according to an example embodiment.

FIG. 6 is a flowchart illustrating an operation of the controller 130, according to an example embodiment.

First, the controller 130 determines whether the first drying device 110 is operated, at step S610. In a case in which the first drying device 110 is not operated, a problem does not occur and thus, no additional step is carried out.

If the first drying device 110 is operated, the controller 130 determines whether the second drying device 120 is operated, at step S620. In a case in which the second drying device 120 is not operated, a problem does not occur and thus, no additional step is carried out.

The controller 130 may perform the determination as described above, to prevent occurrence of a problem in advance. In addition, the controller 130 may determine whether the second drying device 120 is operated, first.

If the second drying device 120 is operated, the controller 130 may determine a drying device of which a heating performance is to be reduced, at step S630. For example, the controller 130 may determine a drying device of which a heating performance is to be used based on a maximum allowable current range. The controller 130 may determine a drying device of which a heating performance is to be reduced in order to produce a maximum performance within the maximum allowable current range.

Alternatively, the controller 130 may determine a drying device of which a heating performance is to be reduced based on a priority set by the user. For example, when the user desires to end the drying operation of the first drying device 110 first, the controller 130 may reduce a heating performance of the second drying device 120.

Alternatively, the controller 130 may determine a drying device of which a heating performance is to be reduced based on at least one of a texture, thickness and type of the laundry. For example, in a case in which clothes are input to the first drying device 110 and a bedding is input to the second drying device 120, the controller 130 may perform a drying operation of the first drying device and reduce a heating performance of the second drying device 120.

When a drying device of which a heating performance is to be used is determined, the controller 130 may reduce a heating performance of the determined drying device, at step S640. In addition, the controller 130 may determine, in real time, whether a drying operation of a drying device of which a heating performance is maintained has been ended.

When the corresponding drying operation is ended, the controller 130 may recover a heating performance of a drying device of which a heating performance is reduced and finish the remaining drying operation.

Figure 7:
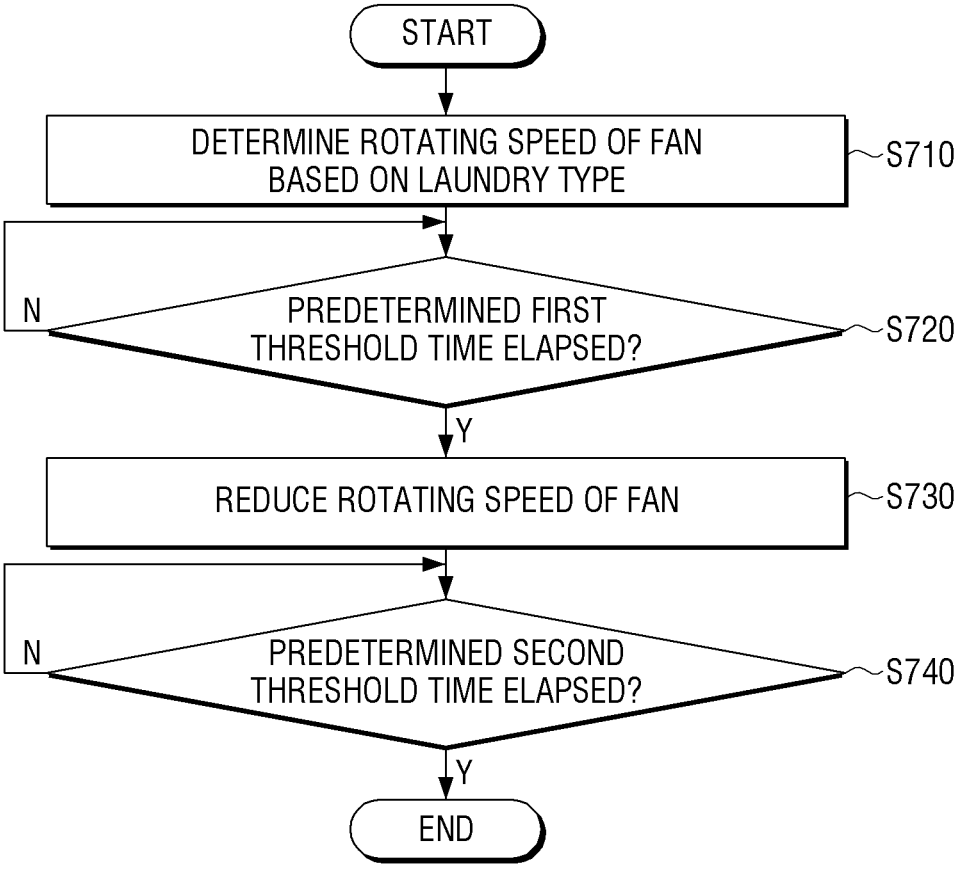
FIG. 7 is a flowchart illustrating a rotation speed of a fan, according to an example embodiment.

FIG. 7 is a flowchart illustrating a rotation speed of a fan, according to an example embodiment.

First, the controller 130 may determine a rotating speed of a fan based on a type of the laundry, at step S710. Alternatively, the controller 130 may determine a rotating speed of a fan based on an amount of the laundry.

The controller 130 may determine whether the fan has rotated during a predetermined first threshold time at a first rotating speed, at step S720. When the predetermined first threshold time has elapsed, the controller 130 may reduce a rotating speed of the fan to a second rotating speed, at step S730.

The controller 130 may determine whether the fan has rotated during a predetermined second threshold time at a second rotating speed, at step S740. When the predetermined second threshold time has elapsed, the controller 130 may end the drying operation.

Figure 8:
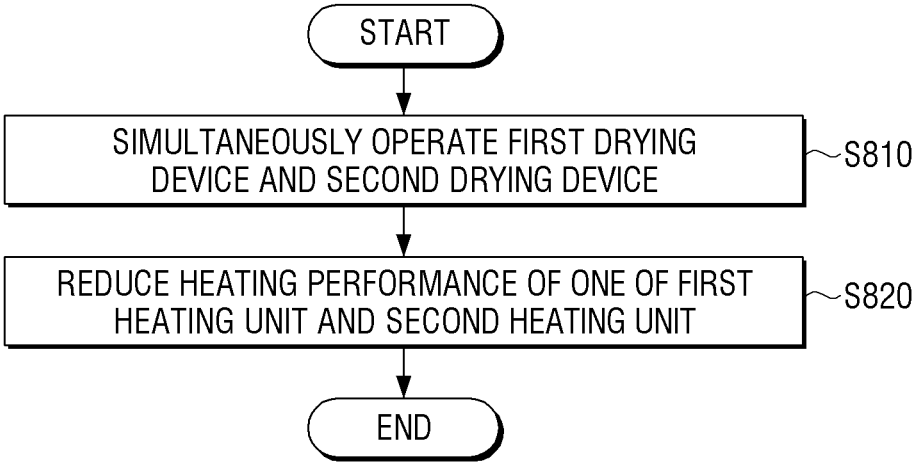
FIG. 8 is a flowchart illustrating a control method of a drying apparatus, according to an example embodiment.

FIG. 8 is a flowchart illustrating a control method of a drying apparatus, according to an example embodiment.

A method for controlling a drying apparatus which includes a first drying device including a drying basket and a first heating unit configured to provide hot air to the drying basket, and a second drying device including a drying drum and a second heating unit configured to provide hot air to the drying drum includes simultaneously operating the first drying device and the second drying device, at step S810. Then, a heating performance of one of the first heating unit and the second heating unit is reduced, at step S820.

In this case, the reducing the heating performance, step S820, includes, in a state in which any one of the first drying device and the second drying device is operated, when a turn on command with respect to the other one of the first drying device and the second drying device is input, reducing a heating performance of one of the first heating unit and the second heating unit.

In this case, the second heating unit has higher power consumption than the first heating unit, and the reducing the heating performance, S820, may include, when the first drying device and the second drying device are simultaneously operated, a heating performance of the second heating unit.

In this case, the second heating unit may be a gas heater which includes an igniter and a valve for providing gas to the igniter, and the reducing the heating performance, S820, may include blocking power supply applied to the igniter and reducing a heating performance of the second heating unit.

In addition, the second heating unit may include a plurality of electric heaters, and the reducing the heating performance may include blocking power supply applied to at least one from among the plurality of electric heaters and reducing a heating performance of the second heating unit.

In addition, in a state in which a heating performance of the second heating unit is reduced, when a drying operation by the first drying device is ended, the method may further include restoring a heating performance of the second heating unit.

Meanwhile, the method may further include, when the first drying device is operated, heating air by the electric heater included in the first heating unit and generating air flow to allow air heated by the electric heater to flow into the drying basket.

In this case, hot air provided to the drying basket is of a lower temperature than hot air provided to the drying drum, and the method may further include reducing a rotating speed of the fan after a predetermined threshold time.

The method may further include sensing at least one from among humidity and temperature of the drying basket and reducing a rotating speed of the fan based on at least one from among the sensed humidity and temperature.

According to the above-described various example embodiments, a drying apparatus may, when a plurality of drying devices are simultaneously operated, reduce a performance of one of the plurality of drying devices and simultaneously operate the plurality of drying device within an allowable current range.

It is described above that a drying apparatus includes a first drying device and a second drying device; however, it may not be limited thereto. For example, the technique described above is applicable to a washing apparatus including a first washing device and a second washing device, as well. Alternatively, the technique described above is applicable to an apparatus in which a washing apparatus and a drying apparatus are combined with each other, as well. In addition, the technique described above is applicable to an apparatus in which an apparatus other than a washing apparatus is combined with a drying apparatus, as well.

The methods according to various exemplary embodiments may be programmed and stored in various storage media. Accordingly, the methods according to the above-mentioned various exemplary embodiments may be realized in various types of electronic apparatuses to execute a storage medium.

Specifically, a non-transitory computer-readable medium where a program for performing the above-described controlling method sequentially may be provided.

The non-transitory computer readable medium refers to a medium that stores data semi-permanently rather than storing data for a very short time, such as a register, a cache, a memory or etc., and is readable by an apparatus. In detail, the above-described various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like, and may be provided.

For example, at least one of these components, elements, modules or units may use a direct circuit structure, such as a memory, a processor, a logic circuit, a look-up table, etc. that may execute the respective functions through controls of one or more microprocessors or other control apparatuses.

What is claimed is:

1. A drying apparatus, comprising:

a first drying device including a drying basket and a first heater configured to provide hot air to the drying basket;

a second drying device which is coupled with the first drying device and includes a drying drum and a second heater configured to provide hot air to the drying drum, the second heater including a second main heater and a second sub heater, the second heater having a power consumption higher than a power consumption of the first heater, and a power consumption of the second main heater being greater than a power consumption of the second sub heater; and a controller configured, in response to the first drying device and the second drying device being simultaneously operated, to control the second heater to operate at a lower temperature at which hot air is generated to thereby reduce a heating performance of the second heater, wherein the controller is further configured to control such that the second main heater is applied power and the second sub heater is not applied power when the controller operates the second heater during the first heater is supplied power.

2. The drying apparatus as claimed in claim 1, wherein the controller reduces the heating performance of the second heater:

in a state in which any one of the first drying device and the second drying device is being operated and a turn-on command with respect to another one from among the first drying device and the second drying device is input, or in a state in which the first drying device and the second drying device are requested to start operating simultaneously.

3. The drying apparatus as claimed in claim 1, wherein the second heater comprises a gas heater including an igniter and a valve configured to provide gas to the igniter, and wherein the controller reduces the heating performance of the second heater by blocking power supply applied to the igniter.

4. The drying apparatus as claimed in claim 1, wherein each of the second main heater and the second sub heater is an electric heater, and wherein the controller reduces the heating performance of the second heater by blocking a power supply applied to the second sub heater.

5. The drying apparatus as claimed in claim 1, wherein the controller, in response to completion of a drying operation by the first drying device, restores the heating performance of the second heater.

6. The drying apparatus as claimed in claim 1, wherein the first heater includes:

an electric heater configured to heat air; and a fan configured to generate air flow to allow air heated by the electric heater to enter the drying basket.

7. The drying apparatus as claimed in claim 6, wherein the first heater provides hot air to the drying basket at a lower temperature than hot air provided to the drying drum by the second heater, and wherein the controller reduces a rotating speed of the fan after a predetermined threshold time.

8. The drying apparatus as claimed in claim 6, wherein the first drying device further includes a sensor configured to sense at least one from among a humidity and temperature of the drying basket, and wherein the controller reduces a rotating speed of the fan based on the sensed at least one from among the humidity and temperature sensed by the sensor.

9. The drying apparatus as claimed in claim 6, wherein the controller changes a rotating speed of the fan based on at least one from among a type and weight of laundry input into the drying basket.

10. The drying apparatus as claimed in claim 1, wherein the first drying device is coupled with an upper end of the second drying device and receives a power supply from the second drying device.

11. A control method of a drying apparatus including a first drying device a second drying device, the method comprising:

operating one or more of the first drying device and the second drying device, the first drying device including a drying basket and a first heater configured to provide hot air to the drying basket and the second drying device being coupled with the first drying device and including a drying drum and a second heater configured to provide hot air to the drying drum, the second heater including a second main heater and a second sub heater and the second heater having a power consumption higher than a power consumption of the first heater; and in response to the first drying device and the second drying device being simultaneously operated, operating the second heater at a lower temperature at which hot air is generated thereby to reducing a heating performance of the second heater, wherein a power consumption of the second main heater is greater than a power consumption of the second sub heater, and wherein the operating of the second heater at the lower temperature control includes applying power to the second main heater while no power is applied to the second sub heater and the first heater is supplied power.

12. The control method as claimed in claim 11, wherein the operating of the second heater at the lower temperature occurs:

in a state in which any one from among the first drying device and the second drying device is being operated and a turn-on command with respect to another one from among the first drying device and the second drying device being is input, or in a state in which the first drying device and the second drying device are requested to start operating simultaneously.

13. The control method as claimed in claim 11, wherein the second heater comprises a gas heater including an igniter and a valve configured to provide gas to the igniter, and wherein the operating of the second heater at the lower temperature comprises reducing the heating performance of the second heater by blocking power supply applied to the igniter.

14. The control method as claimed in claim 11, wherein each of the second main heater and the second sub heater is an electric heater, and wherein the operating of the second heater at the lower temperature comprises reducing the heating performance of the second heater by blocking power supply applied to the second sub heater.

15. The control method as claimed in claim 11, further comprising:

recovering the heating performance of the second heater, in response to completion of a drying operation by the first drying device.

16. The control method as claimed in claim 11, further comprising:

in response to the first drying device being operated, heating air by an electric heater included in the first heater; and generating air flow by a fan included in the first heater to allow air heated by the electric heater to enter the drying basket.

17. The control method as claimed in claim 16, wherein hot air provided to the drying basket is lower in temperature than hot air provided to the drying drum, wherein the method further comprises reducing a rotating speed of the fan after a predetermined threshold time.

18. The control method as claimed in claim 16, further comprising:

sensing at least one from among a humidity and temperature of the drying basket; and reducing a rotating speed of the fan based on the sensed at least one from among the humidity and temperature.

* * * * *